United States Patent [19]

Keiser

[11] Patent Number: 4,668,958

[45] Date of Patent: May 26, 1987

[54] PANEL SYSTEM FOR SHIELDING MICROWAVE ANTENNAS

[75] Inventor: Bernhard E. Keiser, Vienna, Va.

[73] Assignee: The Reinforced Earth Company, Arlington, Va.

[21] Appl. No.: 747,007

[22] Filed: Jun. 20, 1985

[51] Int. Cl.[4] ..... H01Q 1/52; H01Q 15/20

[52] U.S. Cl. ..... 343/916; 343/841

[58] Field of Search ..... 343/916, 907, 841, 911, 343/915

[56] References Cited

U.S. PATENT DOCUMENTS

| | | | |
|---|---|---|---|
| 2,594,871 | 4/1952 | Chu et al. . | |
| 2,936,453 | 5/1960 | Coleman | 343/915 |
| 3,300,268 | 1/1967 | Straub . | |
| 3,314,071 | 4/1967 | Lader et al. | 343/912 |
| 3,427,625 | 2/1969 | Kazimi | 343/914 X |
| 3,495,265 | 2/1974 | Smith | 343/911 R |
| 3,683,394 | 8/1982 | Smith | 343/841 |
| 3,732,653 | 5/1973 | Pickett | 52/71 |
| 3,733,609 | 5/1973 | Bartlett | 343/782 |
| 3,982,249 | 9/1976 | Toman | 343/841 |
| 4,342,033 | 7/1982 | De Camargo | 343/753 |
| 4,513,293 | 4/1985 | Stephens | 343/914 X |
| 4,568,945 | 2/1986 | Winegard et al. | 343/916 |

FOREIGN PATENT DOCUMENTS

| | | | |
|---|---|---|---|
| 0643002 | 6/1962 | Canada | 343/916 |
| 0825665 | 3/1938 | France | 343/841 |

OTHER PUBLICATIONS

Price et al., "Transmission Loss Predictions for Tropospheric Communication Circuits", National Bureau of Standards Technical Note 101, as revised Jan. 1, 1967.

McCue, "Remarks on Anti-RFI Fences", IEEE Transactions on Electromagnetic Compatability, vol. EM-C-23, No. 1, pp. 28-32, Feb. 1, 1981.

Becker, et al., "A Double-Slot Radar Fence for Increased Clutter Supression", IEEE Transactions on Antennas and Propogation, vol. AP-16, No. 1, pp. 103-108, Jan., 1968.

Becker, et al., "Control of Radar Site Environment By Use of Fences", IEEE Transactions on Antennas and Propogation, vol. AP-14, No. 6, pp. 768-773, Nov., 1966.

Ruze, et al., "Radar Ground-Clutter Shields", Proceedings of the IEEE, vol. 54, No. 9, pp. 1171-1183, Sep., 1966.

Takada, et al., "An Application of the Diffractor Grating to the II-Gc/s Microwave Systems", IEEE Transactions on Antennas and Propogation, vol. AP-13, No. 4, pp. 532-541, Jul. 1965.

Preikschat, "Screening Fences for Ground Reflection Reduction", The Microwave Journal, pp. 46-50, Aug. 1964.

Waite, et al., "Diffraction of Electromagnetic Waves By Smooth Obstacles for Grazing Angles", Journal of Research of the National Bureau of Standards—D. Radio Propagation, vol. 63D, pp. 181-197, Sep.-Oct. 1959.

Fanwall brochure: "RF Interference Shield", 1983.

*Primary Examiner*—Daniel M. Yasich

*Attorney, Agent, or Firm*—Allegretti, Newitt, Witcoff & McAndrews, Ltd.

[57] ABSTRACT

A construction for shielding microwave antennas is disclosed including a plurality of RF reflective modular panels positioned to surround a microwave antenna location. Each modular panel has the surface of at least one side adapted to reflect RF signals away from the antenna location. The construction includes a frame for supporting the panels, and a means for connecting the panels to the frame. In the preferred embodiment, the panels are reflective of RF signals on both sides of the panel, with the side of the panel facing the antenna location reflecting RF signals upward and the side away from the antenna location reflecting signals downward. The preferred embodiment also includes dual inclined-step reflectors to achieve the directional reflection, preferrably prepared with a cross-section defining a plurality of linked Z's.

14 Claims, 15 Drawing Figures

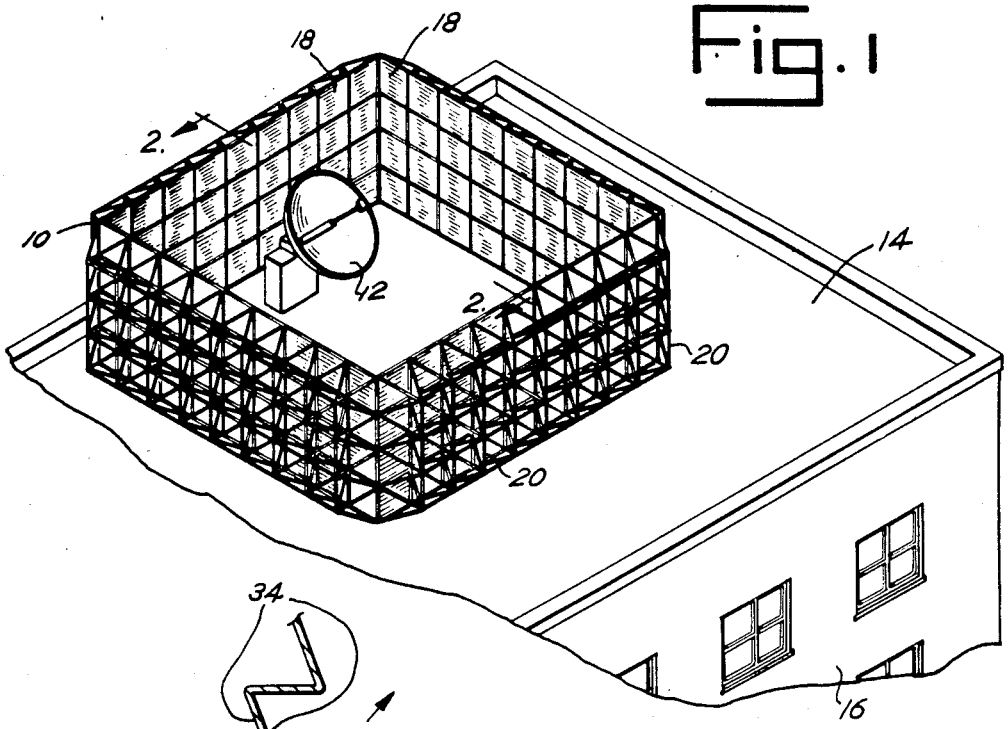
Fig. 1
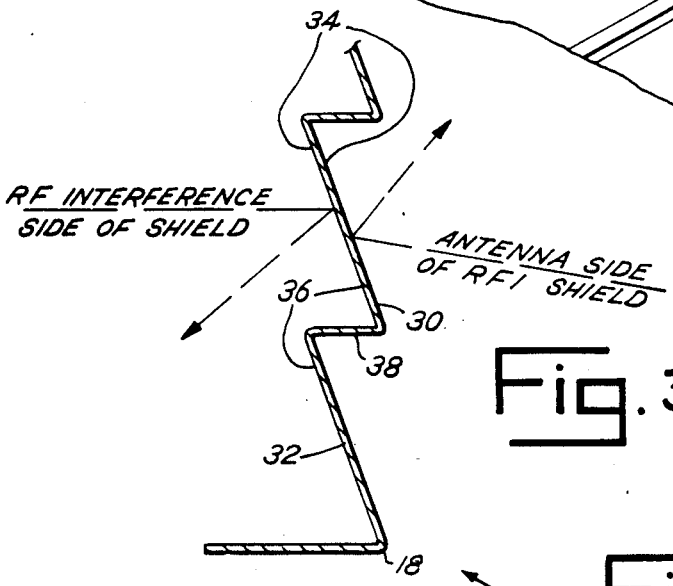
Fig. 3
Fig. 2
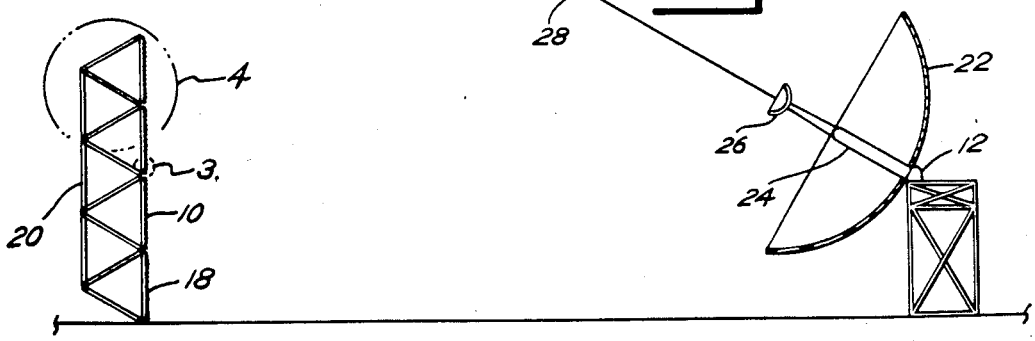

Fig. 4
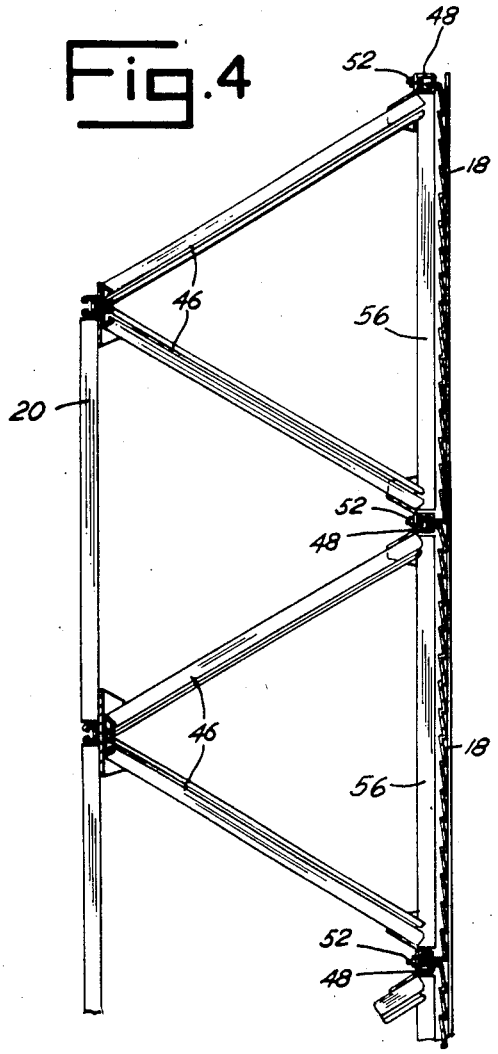
Fig. 5
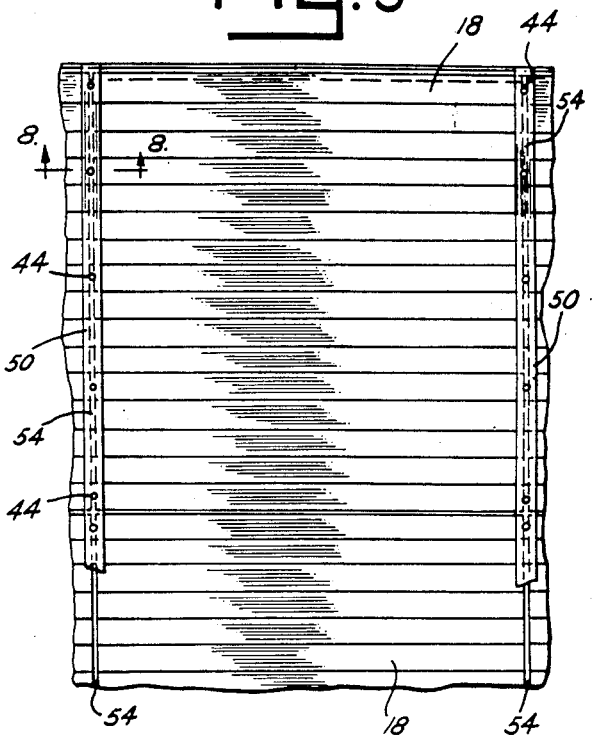
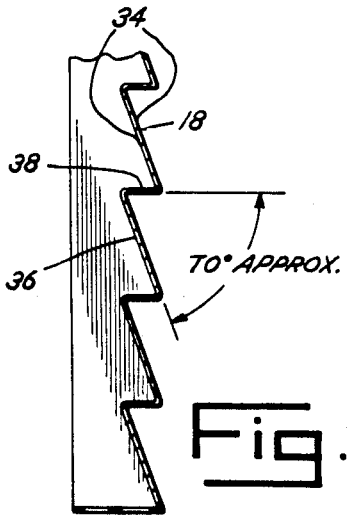
Fig. 7
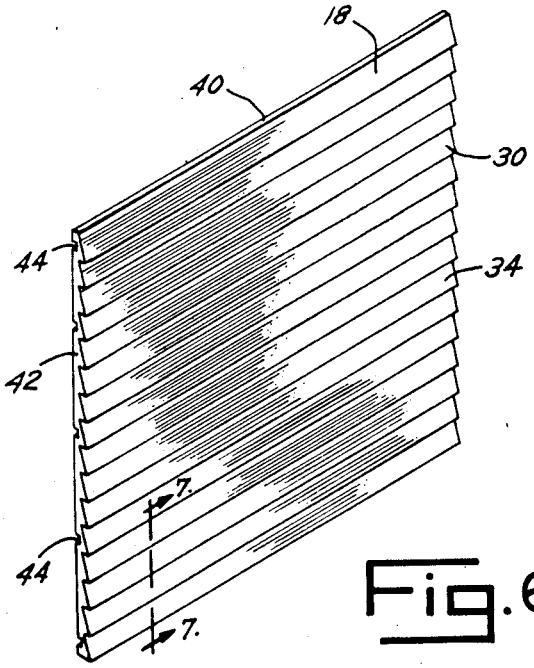
Fig. 6

PANEL SYSTEM FOR SHIELDING MICROWAVE ANTENNAS

BACKGROUND OF THE INVENTION

This invention relates to a construction for a shielding microwave antennas from receipt or transmission of undesirable or interfering radio frequency (RF) signals. More particularly, this invention relates to a microwave antenna shield wall for satellite earth stations constructed of a plurality of modular RF reflective panels that both shields the antenna location from unwanted RF interference and controls internal reflection of RF signals originating within the shield wall.

Antennas used to communicate with satellites by transmitting or receiving RF signals in the microwave bands often must be shielded to properly control receipt or transmission of undesirable RF signals. When receiving signals from a satellite, microwave antennas are highly susceptible to interference, usually in the range of 3.7 to 4.2 GHz (3.7 to 4.2 billion Hertz), derived from nearby RF sources or ground reflection. Such interference may result from a variety of sources, including direct transmitting sources such as other satellite microwave communication antennas or the microwave portions of a telephone communication network. RF interference may also consist of RF signals reflected from nearby ground objects. In radar antennas, reflection from ground souces is known as "clutter." When transmitting signals, especially in urban locations or other sites having a relatively dense concentration of satellite communication stations, microwave antennas must be shielded to minimize escape of RF signals at ground level that cause interference to other antennas. Such outgoing signals are usually in the range of 5.9 to 6.5 GHz.

Prior antenna shield systems have adopted several approaches to interference and clutter elimination. Because microwave radiation is propagated along line of sight paths, the most common protection technique has been to install antennas in a location surrounded by solid, microwave absorbing or reflecting obstructions. Natural barriers such as hills, valley walls or quarry walls are effective in minimizing interference; where natural barriers are unavailable, earthen barriers or reflective shield fences must be constructed.

In densely populated or highly urbanized areas, natural barriers are often either unavailable or inconveniently located. Use of earthen berms also requires construction of substantial and usually relatively tall structures, which are costly, and in any event require more land area than is often available in urban locations. Accordingly, the most common method for eliminating RF interference or clutter in urban areas has been to construct shield walls or fences.

In their simplest form, shield walls or fences usually consist of a simple electrically conducting fence surrounding at least the sides of the antenna that are susceptible to RF interference, unwanted clutter, or radiation discharge. Such fences have frequently consisted of a metallic mesh fence with sufficiently small openings to block an acceptable portion of the unwanted radiation. In all mesh fences or reflectors, the size of the opening is a direct function of the RF signal that the system is designed to reflect. Generally, shield fences must produce at least a 30 dB reduction (known as "attenuation") in the radiation passing through the shield to be effective.

In the past, shield fences have usually been constructed of a unitary or built-in place structure, often made from earth, concrete, or a variety of standard fencing materials. Additionally, such shield fences have typically been constructed to prevent transmission of RF signals; accordingly, the material for the fence has either been made extremely thick to result in complete absorption of RF signals (such as an earthen wall) or has been made of an RF reflective material such as a metal.

Past structures, while effective in limiting RF interference, usually must be specially constructed for the particular location, and in any event, are often unsuitable for rooftop antenna locations, as the construction techniques for prior rooftop shields are labor intensive, unwieldy and therefor expensive, or in the case of earth or concrete structures, nearly impossible. Prior constructions have also required a design unique to the individual location, because such designs have not been developed from standardized, modular elements.

OBJECTS OF THE INVENTION

Accordingly, it is an object of this invention to provide a construction for shielding microwave antenna locations from receipt or transmission of unwanted RF signals.

Another object of this invention is to provide a modular structure for shielding a microwave antenna location, with the structure capable of being developed in a variety of sizes or configurations using the same modular components.

A further object of this invention is to provide a microwave antenna shield construction that is inexpensive to manufacture and install.

Yet another object of this invention is to provide a microwave antenna shielding structure that is suitable for construction on the roof of buildings or related structures.

Another object of this invention is to provide a microwave antenna shielding construction that is capable of directing both incoming RF interference and outgoing microwave signals that contact the wall away from the antenna location.

Still a further object of this invention is to provide a microwave antenna shielding construction that is simple to assemble and uses relatively few parts.

An additional object of this invention is to provide a microwave shielding construction that can be built on the roof of a structure simply, inexpensively and with minimum need for elaborate construction equipment.

SUMMARY OF THE INVENTION

These and other objects of the invention are achieved by providing a construction for shielding microwave antennas that include a plurality of modular RF reflective panels positioned to surround a microwave antenna location, with each panel having the surface of at least one side adapted to reflect RF signals away from the antenna location. The construction also includes a frame for supporting the panels, and a means for connecting the panels to the frame. In the preferred embodiment, the panels are reflective of RF signals on both sides of the panel, with the side of the panel facing the antenna panel location reflecting RF signals upwardly and the side away from the antenna location reflecting signals downwardly. The preferred embodiment of the panels is configured as a dual inclined-step reflector, by having a cross-section defining a plurality of linked Z's.

In the preferred embodiment, the frame is a space truss system with each truss element supporting a single modular panel. The frame may also be constructed as a conventional beam support. The means for connecting the panels to the frame preferably comprises a clamp adapted to secure adjacent panels. The opposed elements of the clamp generally include a flat sheet and a channel beam, with a bolt passing through the sheet between the edges of the adjacent panels and threaded into a nut that interlocks with the channel beam. In the alternative, the means for connecting the panels to the frame may comprise a flange extending from a beam that is part of the frame with the panels having elongated edges fastened to the flange.

BRIEF DESCRIPTION OF THE DRAWINGS

FIG. 1 is a perspective view of an embodiment of the invention mounted on the roof of a structure disclosing a series of modular shield panels supported by a space truss.

FIG. 2 is a side cross-sectional elevation of a section of FIG. 1 illustrating the relationship of a microwave antenna to segments of the RF shielding wall of FIG. 1.

FIG. 3 is a cross-sectional view of a segment of the wall shown in FIG. 2 illustrating reflection of RF interference from inside and outside the wall.

FIG. 4 is a side elevational view of another segment of the wall shown in FIG. 2 illustrating connection of a space truss frame to the modular panels.

FIG. 5 is a front view of the structure shown in FIG. 4 further illustrating the connection of modular panels to a space truss frame.

FIG. 6 is a perspective view of a single modular panel.

FIG. 7 is a side cross-sectional view of a portion of the panel illustrated in FIG. 6.

Figure 8:
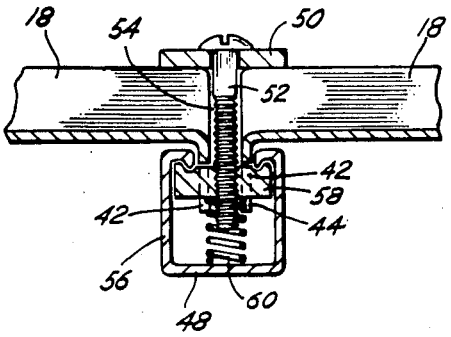
FIG. 8 is a top cross-sectional view of the joint between adjacent modular panels illustrating connection of modular panels to a space truss frame.

In the following detailed description, directional terms such as upper, lower, top, bottom and the like, are used to relate the invention to the normal orientation of a support frame or wall. Terms of this type are used for the convenience of the person of ordinary skill in the art, and are not to limit the scope of any patent issuing on the present invention, unless expressly included in the claims.

DETAILED DESCRIPTION OF THE PREFERRED EMBODIMENT

Referring now to the drawings, and more particularly to FIG. 1, the invention comprises a shield wall 10 suitable for shielding one or more microwave antennas 12. In the preferred embodiment, the shield wall 10 is mounted on the roof 14 of a structure such as building 16. The shield wall principally consists of a plurality of modular panels 18 supported by a frame 20, and includes a mechanism for connecting the modular panels to the frame. The wall shown in FIG. 1 surrounds the antenna 12; however, in some applications the wall may be positioned on only some of the sides of the antenna location.

Additionally, the frame 20 of FIG. 1 is shown of uniform height around the antenna 12. However, the wall may be constructed at different heights around the antenna 12 to provide different amounts of protection against expected interference. Moreover, the wall need not be constructed in a square configuration, but may be constructed in any of a variety of shapes, such as circles, triangles or any other configuration that appropriately shields the antenna location. Finally, while FIG. 1 illustrates only a single antenna 12, the invention is appropriate for use with an antenna location having a plurality of antennas.

Further details of the invention are illustrated in FIG. 2. In functioning as a mechanism for shielding a microwave antenna 12, the shield wall 10 need not completely shield the antenna's entire reflector 22. However, the shield wall 10 must protect a major portion of the reflector surface, including the feedhorn 24 and the subreflector 26 from unwanted RF signals. The shield wall should also not be configured to block the main microwave signal 28, but should deflect stray RF signals that may be generated by the microwave antenna 12 or its supporting equipment.

Details of the preferred embodiment of a modular panel construction are illustrated in FIG. 6. Generally, each modular panel 18 is constructed of an RF reflective material that substantially blocks transmission of RF signals. In the alternative, either the front 30 or the rear (not shown) of each panel 18 should be coated with an RF reflective material, or both. Such coating can be accomplished by any of a variety of techniques that are well known in the art. To assist in controlling RF signals reflected from the panels, the preferred embodiment of the panels are constructed with a dual inclined-step reflector creating a cross section defining a plurality of linked Z's. As illustrated in FIG. 3, the inclined-step on the front or antenna side of the panel 30 reflects RF signals upwardly, while the inclined-step on the back or interference side of the panel 32 reflects RF interference down. In this manner, stray radiation from within the wall is reflected away from the vicinity of the microwave antenna 12, while interference derived from sources outside the wall 10 is also reflected away from the antenna location, but in a downward direction.

As best illustrated in FIG. 7, the preferred embodiment of the panel 18 includes the dual inclined-step reflector 34 having an approximate 70° angle between each inclined portion 36 and each step portion 38. While many other incline angles may be used, the 70° angle is considered optimum for minimizing both internal and external interference caused by signals reflected from the panel 18.

The preferred embodiment of the modular panels 18 also include both top edges 40 and side edges 42. The edges are used to assist connection of the panel 18 to the frame 20, as discussed later in greater detail. The preferred embodiment also includes a plurality of notches 44 for receiving a nut 58 or other threaded element that is matable with a bolt system for connecting the panel 18 to the frame 20. Such a system is also discussed in greater detail later in this disclosure. In alternative embodiments that do not use nuts as part of the connection mechanism, the notches 44 need not be included.

Referring now to FIGS. 4 and 5, a frame 20 and a means for connecting the panels 18 to the frame 20 are illustrated. Generally, the preferred embodiment of the frame comprises a space truss 46 configured with each truss element extending to the periphery of a corresponding panel 18. Each panel 18 is secured against its respective space truss 46 at its side edges 42 or top edges 40 by means of a connector 48. In the preferred embodiment, each connector includes a clamp plate 50 secured by a bolt 52 at the notches 44 in the panel 18. The clamp plate 50 is preferably positioned along a joint 54 between the edges 40 or 42 of adjacent panels 18.

Figure 9:
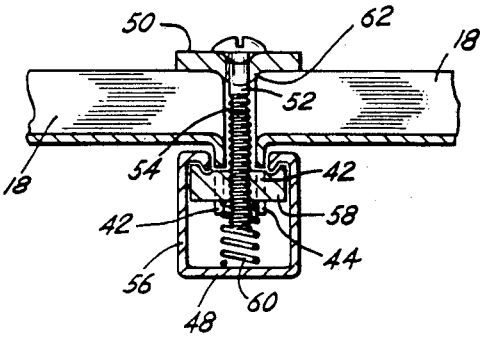
FIG. 9 is also a top cross-sectional view of the joint between two adjacent modular panels illustrating an alternative connection of modular panels to a space truss frame.
Figure 10:
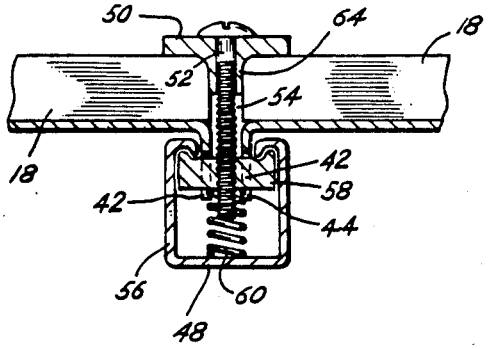
FIG. 10 is a top cross-sectional view of the joint between adjacent modular panels illustrating another alternative connection of modular panels to a space truss frame.

As illustrated in FIGS. 8–10, various alternatives are possible for the connector 48. Details are disclosed for three variations of the connector means in these figures. A first embodiment is disclosed in FIG. 8, which illustrates a clamp for connecting the panels 18 to the frame 20. Generally, a pair of panels 18 are secured at their joint 54 by a clamp having a clamp plate 50, a bolt 52, and a channel beam 56. The bolt 50 extends into the joint 54 and is threaded into a nut 58 that fits within the notch 44. In the preferred embodiment, the nut 58 is matable with the interior of the channel beam 56, and is urged by a spring 60 against the interior of the channel beam 56 to ease installation of the connecting means. The panels 18 are therefore clamped between the clamp plate 50 and the channel beam 56, with the clamping force of the channel beam exerted against the side edges 42 of each plate 18 in the notches 44.

An alternative embodiment for the connector 48 is disclosed in FIG. 9. As in the connector disclosed in FIG. 8, the panels 18 are secured by clamping adjacent panel edges between a clamp plate 50 and a channel beam 56. The FIG. 9 alternative includes the same mechanism for clamping as FIG. 8, including a bolt 52, a nut 58 matable with the interior of the channel beam 56, and a spring 60 urging the nut against the channel beam's interior. However, the clamping plate is partially deformed to create a ridge 62 that mates with the joint 54. The ridge 62 makes the connection 48 more rigid, and helps to align adjacent panels 18, especially when the ridge 62 extends the full length of the joint 54 between adjacent modular panels.

FIG. 10 illustrates a further embodiment of the connection means that is identical to the embodiment disclosed in FIG. 9 with the exception of the clamp plate 50. In the embodiment of FIG. 10, the clamping plate does not include a ridge between adjacent panels, but instead has a key 64 that mates with the joint 54 and extends into that joint a distance amounting to a substantial portion of the joint depth. In the preferred embodiment, the key is prepared by extruding a portion of the clamp plate 50 to form the desired configuration. Because the key 64 extends further into the joint than the ridge 62, it provides a more secure fastener than that of embodiments in FIG. 8 and 9 and allows for more precise alignment of adjacent modular panels. In all other respects, the embodiment disclosed in FIG. 10 is identical to the embodiment of FIGS. 8 and 9.

Figure 11:
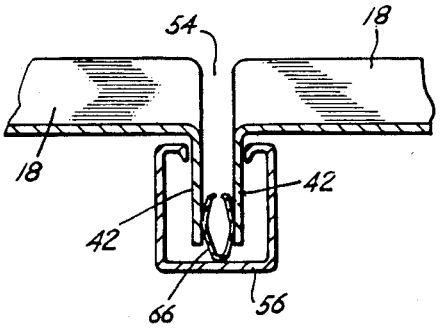
FIG. 11 is a top cross-sectional view of the joint between adjacent modular panels illustrating still another alternative connection of modular panels to a space truss frame.

A further embodiment of the connector 48 is disclosed in FIG. 11. That embodiment uses a leaf spring 66 to secure adjacent panel 18 within a channel beam 56. The leaf spring 66 is compressed within the joint 54 between adjacent panels 18, so that the side edges 42 of adjacent modular panels are forced against the interior of the channel beam 56, thereby attaching the panels by friction to the channel beam. The embodiment disclosed in FIG. 11 uses fewer materials than the embodiments of FIGS. 8–10, and additionally eases construction while increasing removability of both the panel 18 and the leaf spring 66.

The modular panel system of this invention need not be limited to use with a space truss frame. Instead, the modular panel system may be used with any frame capable of supporting a wall, including frames constructed with conventional vertical beams. Frames may be constructed of any material, including aluminum, steel, wood, or even more exotic materials such as plastics, ceramics or composite materials. FIGS. 12–15 illustrate various embodiments for a connector means that attaches modular panels to beams of a conventional frame. Although FIGS. 12–15 illustrate wooden beams, the invention is not so limited and is appropriate for any beam material.

Figure 12:
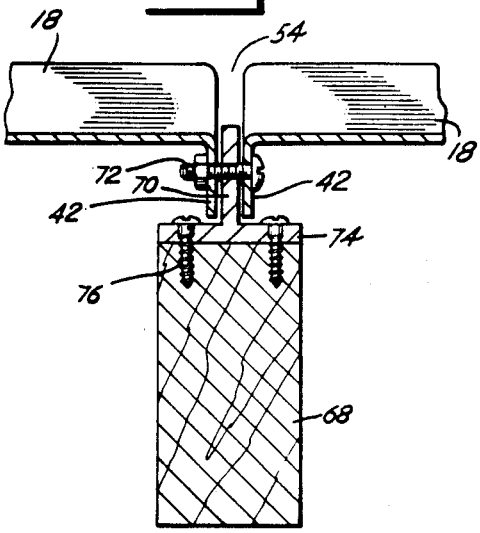
FIG. 12 is a top cross-sectional view of the joint between adjacent modular panels illustrating a connection of modular panels to a conventional beam frame.

Referring now to FIG. 12, in an alternative connector embodiment a pair of adjacent modular panels 18 are attached to a conventional beam 68. A flange 70 is affixed to the beam 68 and extends into the joint 54. The flange 70 may extend along the full length of the joint 54 between adjacent panels 18, or the structure may have a plurality of discrete flanges extending from the beam 68 only where attachment of the panels 18 to the beams is intended.

In the embodiment of FIG. 12, the side edges 42 of the panels 18 are secured to the flange with a flange bolt 72. The FIG. 12 embodiment also places the flange 70 in the joint 54, and thereby separates the adjacent modular panels 18 from contact with each other. Additionally, in the preferred embodiment of the alternative disclosed in FIG. 12, the flange 70 is part of a "T" support 74 connected to the conventional beam 68. The "T" support may be connected to the conventional beam by any fastening means, including bolts or wood screws 76.

Figure 13:
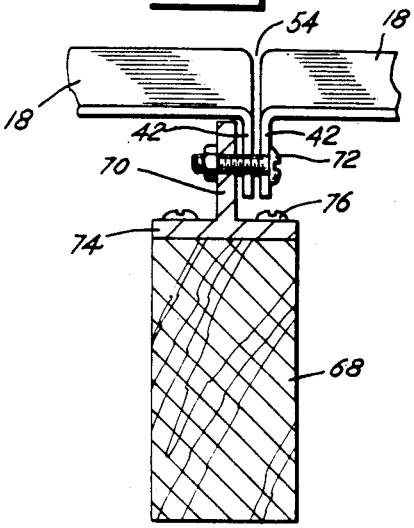
FIG. 13 is a top cross-sectional view of the joint between adjacent modular panels illustrating an alternative connection of modular panels to a conventional beam frame.

FIG. 13 illustrates an alternative embodiment of the connection means disclosed in FIG. 12. FIG. 13 includes all of the elements disclosed in FIG. 12, except that the flange 70 is positioned with both modular panel side edges 42 on one side of that flange 70, such that the flange does not act to separate the adjacent edges of the panels 18 at the joint 54 and the side edges 42 of adjacent panels are in contact when the connector is assembled. The embodiment of FIG. 13 is identical to the embodiment of FIG. 12 in all other respects.

Figure 14:
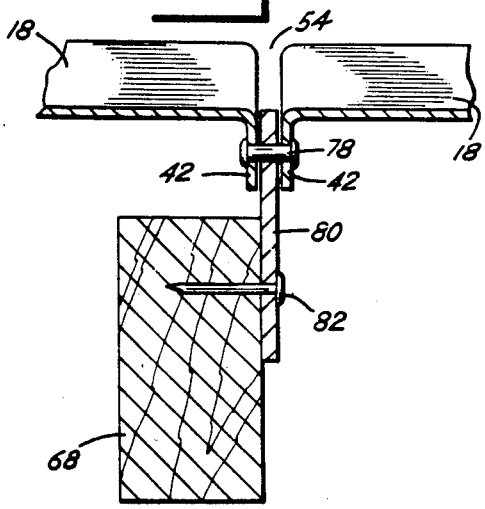
FIG. 14 is a top cross-sectional view of the joint between adjacent modular panels illustrating still another connection of modular panels to a conventional beam frame.
Figure 15:
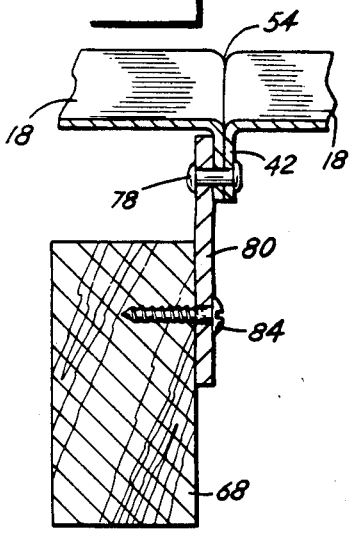
FIG. 15 is a top cross-sectional view of the joint between adjacent modular panels illustrating yet another alternative connection of modular panels to a conventional beam frame.

FIGS. 14 and 15 illustrate additional variations that may be employed to connect the panels 18 to a conventional beam. The connection means need not be a bolt, but instead can be a rivet 78 (or any other equivalent fastening means). Likewise, the panels need not be connected to a flange, but can be connected to a side plate 80 not having a "T" configuration. The side plate 80 can be connected to the conventional beam 68 with any of a variety of fastening means, including nails 82 or wood screws 84. Again, the side plate can be positioned within the joint 54, or with both panel side edges 42 to one side of the side plate.

Although a variety of specific connector embodiments have been disclosed, the invention is not limited to the specific connector embodiments described and illustrated, but includes any means for attaching modular panels to any form of support frame. Likewise, although specific fastener means have been disclosed in the various connectors, any fastener means suitable for connection of the modular panels may be adopted. The embodiment disclosed in FIGS. 12–15 may also be used with panels that do not include notches 44. Further, the particular embodiments disclosed in the figures and described in the specification show only shield walls that reflect RF signals. The invention may also be practiced by preparation of a construction having a structure for controlling diffraction of RF signals over the edges of the wall. Any of a variety of diffraction control structures or means may be adopted, including the diffraction control structure disclosed in my co-pending application Ser. No. 714,093 filed Mar. 20, 1985 for Microwave Shielding for Microwave Satellite Earth Stations. Application Ser. No. 714,093 is hereby specifically incorporated in this specification by reference.

While the preferred embodiment of the present invention has been set forth in the above detailed description, it is to be understood that the preferred embodiment is only one example of the invention. Likewise, the other specific alternative embodiments disclosed should not be considered to be the only embodiments capable of practicing the invention. Other modifications may be used without departing from the scope of the present invention. The invention is limited only by the following claims, including equivalents of elements of the claims where appropriate.

What is claimed is:

1. A construction for shielding microwave antennas from unwanted transmission or receipt of RF signals, comprising, in combination:

a plurality of RF reflective modular panels positioned to surround a location containing one or more microwave antennas, the panels each having the surface of at least one side adapted to reflect RF signals encountering the panels away from the location;

a space frame composed of interlocking space trusses supporting the panels; and a means for connecting the panels to the space frame comprising a clamp adapted to secure adjacent panels between an elongated generally flat sheet and a channel beam element of the space frame, with the channel beam having its open side facing the joint between panels, the channel beam and sheet comprising opposing elements of the clamp and being secured with a bolt passing through the sheet between the edges of adjacent panels that is threaded into a nut configured to interlock with the channel beam.

2. A construction as claimed in claim 1, wherein the panels further comprise edges extending around the periphery of the panels and extending generally perpendicular to the plane of the panels.

3. A construction as claimed in claim 2, wherein the means for connecting the panels to the frame comprises a channel beam element of the space frame fitted over the joint between adjacent panels with the edges of the panel fitting into the beam's channel, and with an elongated leaf spring inserted in the joints slot between adjacent edges of the panels such that the leaf spring urges the panel edges against the interior of the channel and secures the panels to the channel beam.

4. A construction as claimed in claim 2, wherein the panels are mounted on a conventional beam frame.

5. A construction as claimed in claim 2, wherein the frame includes a support beam with an elongated flange extending from the support beam, and the means for connecting the panels to the frame comprises fixedly fastening the elongated flange to the edges of adjacent panels.

6. A construction as claimed in claim 5, wherein the flange extends between the edges of adjacent panels.

7. A construction as claimed in claim 5, wherein both edges of adjacent panels are positioned on the same side of the flange.

8. A construction as claimed in claim 1, wherein the construction is adapted to control diffraction of RF signals over its top.

9. A construction as claimed in claim 1, further comprising a means for urging the nut against the interior of the channel beam.

10. A construction as claimed in claim 1, wherein the elongated generally flat sheet includes a ridge adapted to fit within the slot comprising the joint between panels to assist in maintaining panel alignment.

11. A construction as claimed in claim 10, wherein the ridge further comprises a key mateable with the slot comprising the joint between panels.

12. A construction as claimed in claim 1, wherein the construction is adapted to be mounted on the roof of a structure.

13. A construction as claimed in claim 1, wherein the construction is adapted to be mounted on the ground.

14. A wall construction for shielding one or more microwave antennas from radio frequency interference, comprising, in combination:

a space frame support structure comprised of interlocking space trusses positioned around a location containing one or more microwave antennas;

a plurality of modular panels attached to the support structure, with each panel having a continuous layer of radio frequency reflective material substantially blocking passage of radio frequency radiation through the panel, and with each panel configured as a series of inclined steps having a cross section defining a plurality of linked Z's, the inclined steps being further configured such that the interior panel surface facing the location containing one or more antennas is inclined away from the antennas, and the exterior panel surface matches the interior surface;

a means for attaching each panel to a single space truss, whereby radio frequency interference external to the panels that encounters the panels is reflected downwardly and away from the location containing one or more microwave antennas and microwave signals generated within the same location that encounters the panels is reflected upwardly.

* * * * *